United States Patent [19]

Karashima

[11] 4,269,037

[45] May 26, 1981

[54] REFRIGERATED SHOW CASE

[76] Inventor: Masashi Karashima, 88-5, Nakano, Ebina-shi, Kanagawa-ken, Japan

[21] Appl. No.: 64,628

[22] Filed: Aug. 7, 1979

[30] Foreign Application Priority Data

Jul. 3, 1979 [JP] Japan ..... 54-83441

[51] Int. Cl.[3] ..... A47F 3/04

[52] U.S. Cl. ..... 62/256

[58] Field of Search ..... 62/255, 256, 272, 278

[56] References Cited

U.S. PATENT DOCUMENTS

| | | | |
|---|---|---|---|
| 2,706,387 | 4/1955 | Swanson | 62/255 |
| 3,063,254 | 11/1962 | Dickson et al. | 62/256 |
| 3,229,475 | 1/1966 | Balk et al. | 62/255 |
| 3,756,038 | 9/1973 | MacMaster et al. | 62/256 |
| 3,827,254 | 8/1974 | MacMaster et al. | 62/256 |
| 3,996,763 | 12/1976 | Karashima | 62/256 |

*Primary Examiner*—Lloyd L. King

*Attorney, Agent, or Firm*—Wenderoth, Lind & Ponack

[57] ABSTRACT

A refrigerated show case has a cold air flow circulated along its bottom wall, rear wall and top wall and across its front opening between an ejection port and a suction port disposed along the upper and lower edges, respectively, of the front opening to refrigerate the interior of the show case. There are provided a by-pass port in the top wall for by-passing a part of the cold air flow, a heat-exchanger disposed on the top wall and communicated with the by-pass port, and an ejection port of a moderated air flow communicated with the heat-exchanger and disposed outside of and in parallel to the ejection port of the cold air flow, the moderated air flow being formed from the by-passed cold air flow by heat-exchange with a hot ambient air above the refrigerated show case through the heat-exchanger.

1 Claim, 6 Drawing Figures

REFRIGERATED SHOW CASE

BACKGROUND OF THE INVENTION

The present invention relates in general to a refrigerated show case, and more particularly to improvements in a refrigerated show case of the type wherein a cold air flow is circulated along its bottom wall, rear wall and top wall and across its front opening between an ejection port and a suction port disposed along the upper and lower edges, respectively, of the front opening to refrigerate the interior of the show case.

Heretofore, in such type of refrigerated show case, it has often occurred that a part of a high-temperature high-humidity ambient air contacting with the cold air flow circulating across the front opening from its upper edge towards its lower edge is caught by the cold air flow and thus enters into the show case resulting in frosting, and thereby goods accommodated within the show case are adversely affected.

Also there was a disadvantage that the cold air flow at a reduced temperature would come into direct contact with a customer standing in the passageway in front of the refrigerated show case and thereby would give discomfort to the customer.

SUMMARY OF THE INVENTION

The present invention has been proposed to eliminate the above-described disadvantages of the refrigerated show case of the prior art.

It is one object of the present invention to provide an improved refrigerated show case, which can prevent a high-temperature high-humidity ambient air from entering into the show case through its front opening as caught by the cold air flow circulating across the front opening, and which can prevent the circulating cold air flow from partly going out of the front opening and directly contacting the body of a customer.

According to one feature of the present invention, there is provided a refrigerated show case in which a cold air flow is circulated along its bottom wall, rear wall and top wall and across its front opening between an ejection port and a suction port disposed along the upper and lower edges, respectively, of the front opening to refrigerate the interior of the show case, and which comprises a by-pass port in the top wall for by-passing a part of the cold air flow, a heat-exchanger disposed on the top wall and communicated with the by-pass port, and an ejection port of a moderated air flow communicated with the heat-exchanger and disposed outside of and in parallel to the ejection port of the cold air flow, the moderated air flow being formed from the by-passed cold air flow by heat-exchange with a hot ambient air above refrigerated show case through the heat-exchanger.

Since the refrigerated show case according to the present invention is constructed in the above-featured manner, cold air for refrigerating the interior of the show case that has been sucked through the suction port along the lower edge of the front opening of the show case, comes into contact with and dews a low temperature area of a cold air flow circulating path that is refrigerated by an evaporator within the show case, resulting in reduction of the absolute humidity of the cold air, while it passes through the circulating path along the bottom wall and the rear wall, and the cold air that has its moisture content thus reduced and is held at a low temperature enters the heat-exchanger through the by-pass opening provided in the top wall, so that the cold air has its temperature raised and has its relative humidity lowered by heat-exchange with the hot ambient air above the refrigerated show case. Then a moderated air that has been heated and dehumidified by the heat-exchanger as described above and is held at a comfortable temperature and humidity, is ejected through the additional ejection port for the moderated air that is disposed outside of and in parallel to the cold air ejection port along the upper edge of the front opening of the show case, so that across the front opening is formed an air curtain of the moderated air in front of and in parallel to the air curtain of the cold air. Therefore, this moderated air would come into contact with a customer standing in the passageway in front of the front opening of the show case and the cold air would not come into direct contact with the customer, so that there is no fear that a customer suffers discomfort.

Moreover, since the high-temperature high-humidity ambient air is isolated from the air curtain of the cold air by the air curtain of the aforementioned moderated air, the ambient air would not enter the interior of the show case and result in frosting. In addition, since the aforementioned moderated air has been dehumidified as described above while it circulates through the circulating path in the show case and thus contains a small moisture content, even if it should be caught by the air curtain of the cold air and should partly enter the show case, there would be no fear of frosting within the show case as is the case with the refrigerated show case in the prior art.

BRIEF DESCRIPTION OF THE DRAWINGS

Other features and advantages of the present invention will become more apparent upon a perusal of the following specification taken in connection with the accompanying drawings, wherein.

DETAILED DESCRIPTION OF THE INVENTION

Figure 1:
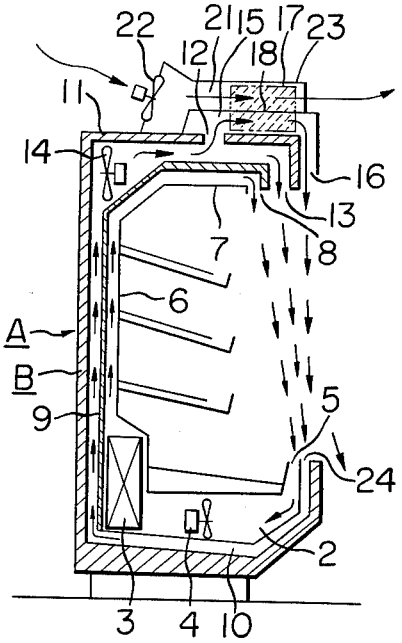
FIG. 1 is a schematic longitudinal cross-sectional view of one preferred embodiment of the refrigerated show case according to the present invention.
Figure 2:
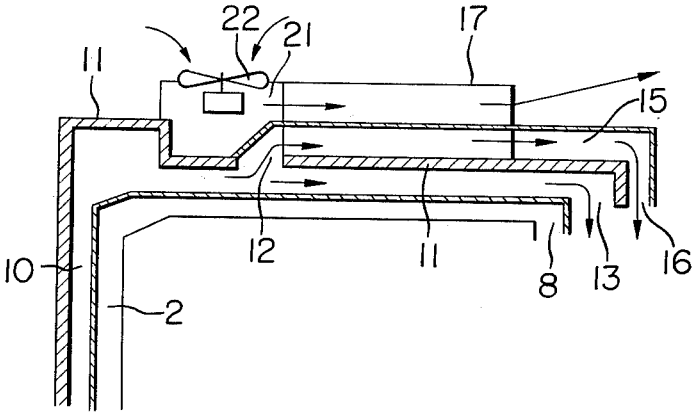
FIG. 2 is an enlarged schematic longitudinal cross-sectional view of a top portion of the refrigerated show case in FIG. 1.
Figure 4:
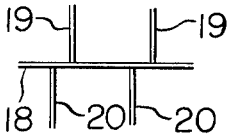
FIG. 4 is an enlarged side view of the portion encircled at IV in FIG. 3, and FIGS. 5 and 6 are schematic longitudinal cross-sectional views of two other preferred embodiments of the present invention.

Referring now to FIG. 1 of the drawings, a refrigerated show case according to the present invention is generally designated by reference A, in which an evaporator 3 and a fan 4 are contained in a duct 2 of a cold air flow for refrigerating goods displayed within the show case. A front end of the duct 2 is communicated with a suction port 5 along a lower edge of a front opening of the show case, while a rear end of the duct 2 extends vertically upwards along a rear wall 6 of the show case, further extends horizontally along a top wall 7 of the show case, and is finally communicated with an ejection port 8 along an upper edge of the front opening of the show case. In this figure, reference numeral 9 designates a heat insulating partition wall disposed within the show case.

Reference B designates a panel enclosing the outside of the above-described show case A, and between the panel B and an outer wall of the duct 2 including the aforementioned heat insulating partition wall 9 is formed another duct 10 which extends in parallel to the duct 2. In addition, in the top wall 11 of the panel B is provided a by-pass port 12 which opens upwards, and the aforementioned duct 10 is communicated with another ejection port 13 disposed along the upper edge of the front opening of the show case outside of and adjacent to the above-described ejection port 8. In this figure, reference numeral 14 designates a fan for circulating cold air through the duct 10.

Above the above-mentioned top wall 11 is provided another duct 15 which extends in parallel to the duct 10 and communicates with the by-pass port 12. One end of the duct 15 is blocked, and the other end is communicated with still another ejection port 16 for a moderated air which port is disposed outside of and in parallel to the aforementioned ejection port 13. Within the duct 15 is provided a heat-exchanger 17 on the downstream side of the by-pass port 12.

Figure 3:
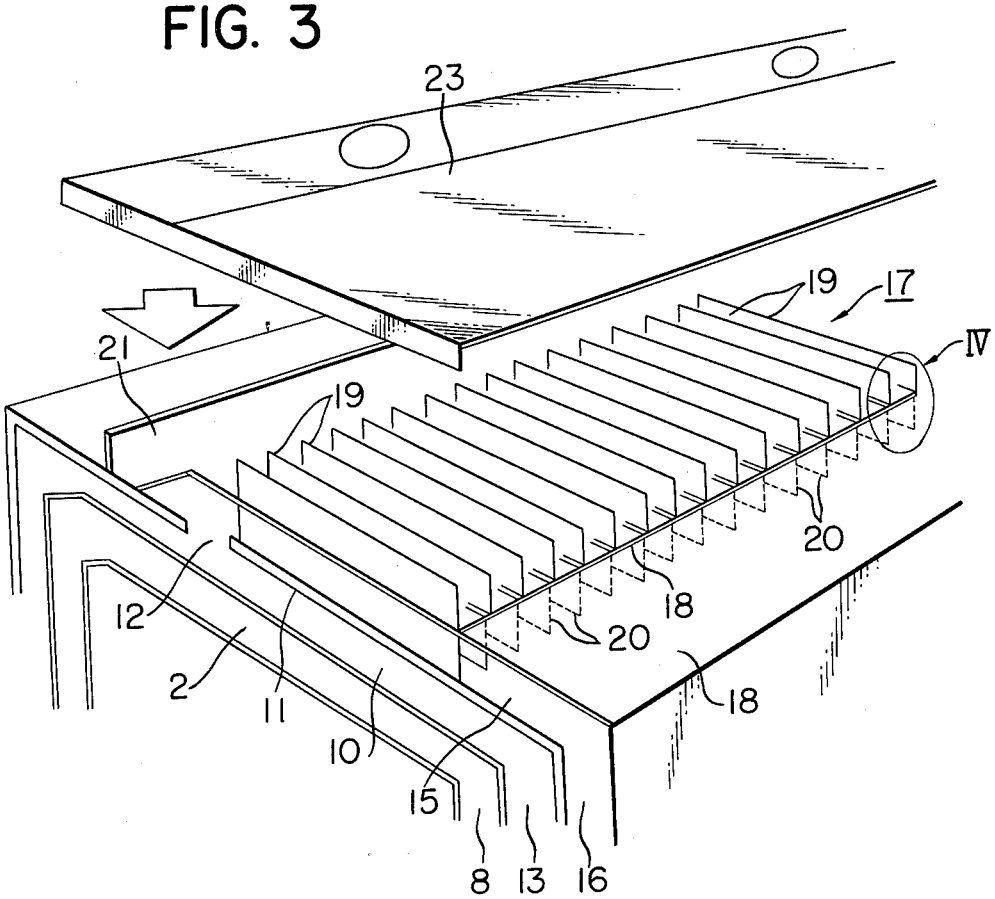
FIG. 3 is a more detailed perspective view of a heat-exchanger section which is only schematically shown in FIG. 2.

The heat-exchanger 17 is divided into a lower chamber for passing cold air which is located within the duct 15 and an upper chamber for passing ambient air above the refrigerated show case as partitioned by a top wall 18 of the duct 15, and fins 19 and 20 are projected from the top wall 18 so as to extend into the upper and lower chambers, respectively, FIG. 3. Reference numeral 21 designates still another duct for introducing ambient air above the refrigerated show case into the upper chamber of the heat-exchanger 17, numeral 22 designates a fan for sucking the ambient air above the refrigerated show case into the duct 21, and numeral 23 designates a top wall of the duct 21 which could be used also as a top wall of the heat-exchanger 17.

Since the refrigerated show case according to the present invention is constructed in the above-described manner, cold air for refrigerating the interior of the show case which has been sucked into the duct 2 by means of the fan 4 passes through the respective sections of the duct 2 in the bottom wall, rear wall 6 and top wall 7 and is ejected from the ejection port 8 along the upper edge of the front opening, then it is sucked into the duct 2 through the suction port 5 along the lower edge of the front opening, and thus refrigerates the goods displayed within the show case while it is circulated along the bottom wall, rear wall 6 and top wall 7.

On the other hand, air sucked into the duct 10 through another suction port 24 along the lower edge of the front opening by means of the other fan 14 is refrigerated by the evaporator 3 and the cold air within the duct 2 while it passes through the respective sections of the duct 10 in the bottom wall, rear wall 6 and top wall 7, then it is ejected from the ejection port 13 along the upper edge of the front opening of the show case and sucked through the suction port 24 along the lower edge of the front opening, and thereby an additional air curtain of a low temperature air is formed outside of the air curtain of the cold air for refrigerating the interior of the show case across the front opening of the show case, so that the cold air may not come into contact with the high-temperature high-humidity ambient air and may not result in a temperature rise.

However, without any further provision, the high-temperature high-humidity ambient air would enter the interior of the show case as caught by the air curtains of the cold air for refrigerating the interior of the show case and the low temperature air ejected from the ejection ports 8 and 13, respectively, resulting in frosting, and thereby would adversely affected the displayed goods in the show case. In addition, the low temperature air flow in the outside air curtain would come into direct contact with a customer standing in the passageway before the front opening of the show case and would cause discomfort to the customer.

However, according to the present invention, the air sucked into the duct 10 is refrigerated by the evaporator 3 and the cold air within the duct 2 and has its absolute humidity lowered due to dewing on the partition wall between the ducts 2 and 10, and a part of the thus dehumidified low-temperature air enters into the duct 15 through the by-pass port 12 in the top wall 11 and then into the lower chamber of the heat-exchanger 17. At the same time, high-temperature ambient air above the refrigerated show case that has been sucked into the duct 21 by the fan 22, enters into the upper chamber of the heat-exchanger 17. In this way the aforementioned low-temperature air is heat-exchanged with the high-temperature ambient air above the refrigerated show case while they pass through the heat-exchanger 17, so that the former is raised in temperature and lowered in relative humidity, and thereby a moderated air which has been regulated so as to have a comfortable temperature and humidity is ejected from the ejection port 16 disposed outside of and in parallel to the ejection port 13 for the low-temperature air, resulting in formation of an additional air curtain of the moderate air outside of the aforementioned air curtain of the low-temperature air. Thus a customer standing in the passageway before the front opening of the refrigerated show case would come into contact with this moderated air and would not come into direct contact with the low-temperature air, and therefore, the customer does not discomfort due to the low-temperature air.

Moreover, the air curtain of the low-temperature air and the high-temperature high-humidity ambient air are isolated by the moderated air so as not to come into direct contact with each other, so that there is no fear that the high-temperature high-humidity air is dragged into the show case resulting in frosting within the show case, and also since the moderated air has been dehumidified as described above, even if it should be dragged into the show case, there is no fear of frosting within the show case.

Figure 5:
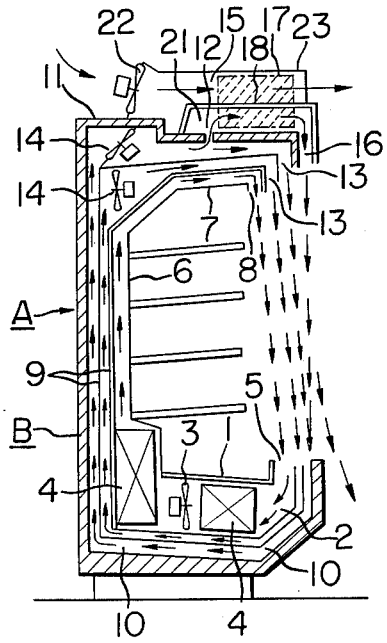
Figure 6:
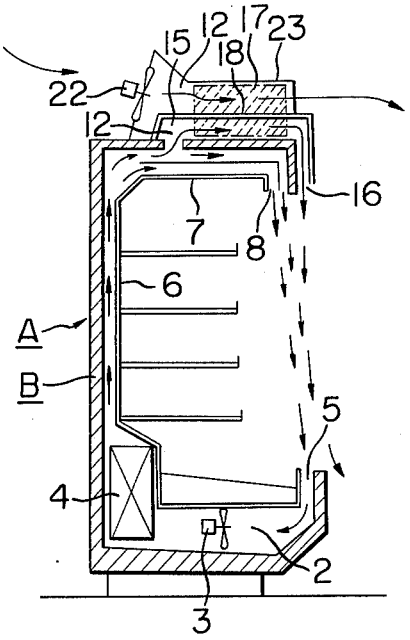

Besides the first preferred embodiment illustrated in FIGS. 1 to 4 and described above, another preferred embodiment of the present invention as applied to a refrigerated show case in which a cold air flow for refrigerating the interior of the show case and two separate flows of low-temperature air circulate along the bottom wall, rear wall and top wall of the show case and across the front opening of the show case, is shown in FIG. 5. Also FIG. 6 shows a still another preferred embodiment of the present invention as applied to a refrigerated show case in which only a cold air flow for refrigerating the interior of the show case circulates along the bottom wall, rear wall and top wall of the show case and across the front opening of the show case. It is to be noted that component members in these alternative embodiments which are equivalent to those shown in the first preferred embodiment are given like reference numerals. Therefore, the constructions and operations of these alternative embodiments will be easily understood from the above description in connection to the first preferred embodiment.

Since many changes could be made in the above construction and many apparently widely different embodiments of this invention could be made without departing from the scope thereof, it is intended that all matter contained in the above description or shown in the accompanying drawings shall be interpreted as illustrative and not as limiting.

I claim:

1. In a refrigerated show case in which a cold air flow is circulated along a show case bottom wall, rear wall and top wall and across a show case front opening between an ejection port and a suction port disposed along the upper and lower edges, respectively, of said front opening between an ejection port and a suction port disposed along the upper and lower edges, respectively, of said front opening to refrigerate the interior of said show case, the improvement wherein said show case further comprises a by-pass port in said top wall for by-passing a part of said cold air flow, a heat-exchanger disposed of said top wall and communicated with said by-pass port, and an ejection port of a moderated air flow communicated with said heat-exchanger and disposed outside of and in parallel to said ejection port of said cold air flow, said moderated air flow being formed from said by-passed cold air flow by heat-exchange with hot ambient air above said refrigerated show case through said heat-exchanger.

* * * * *